US005353492A

United States Patent [19]

Potocnik et al.

[11] Patent Number: 5,353,492

[45] Date of Patent: Oct. 11, 1994

[54] METHOD FOR PRODUCING A MOLDED PLASTIC FLAT ROTARY SWITCH

[75] Inventors: Jože Potočnik; Boris Kogej, both of Idrija, Slovenia

[73] Assignee: Kolektor D.O.O., Idrija, Slovenia

[21] Appl. No.: 987,190

[22] Filed: Dec. 8, 1992

[30] Foreign Application Priority Data

Dec. 9, 1991 [DE] Fed. Rep. of Germany ..... 4140475

[51] Int. Cl.[5] ..... H01R 43/00

[52] U.S. Cl. ..... 29/597; 29/622; 29/882; 29/883; 29/884; 310/235; 310/236

[58] Field of Search ..... 29/597, 622, 882–884; 310/234–236

[56] References Cited

U.S. PATENT DOCUMENTS 3,717,928 2/1973 Yamaguchi ..... 29/597
3,812,576 5/1974 Yamaguchi .
3,958,326 5/1976 Matsumoto et al. ..... 29/597

*Primary Examiner*—Carl E. Hall
*Attorney, Agent, or Firm*—Wigman, Cohen, Leitner & Myers

[57] ABSTRACT

A method for producing a molded plastic and copper flat rotary switch or commutator with parts of the segments lying in a cylindrical surface is disclosed. A cup-shaped unfinished piece is formed by modification of a flat material, having an outside annular flange and a number of axial grooves which are radially open on the inside as well as distributed uniformly around the periphery corresponding to the number of segments in the cylindrical part of the unfinished piece, on the outside of the cylindrical wall of the unfinished piece, a layer with a thickness which corresponds to the radial thickness of the material parts occluding the grooves radially on the outside is pushed, beginning at the flat part corresponding to the subsequent brush contact surface, toward the free end of the casing with formation of the annular flange and opening of the grooves.

8 Claims, 2 Drawing Sheets

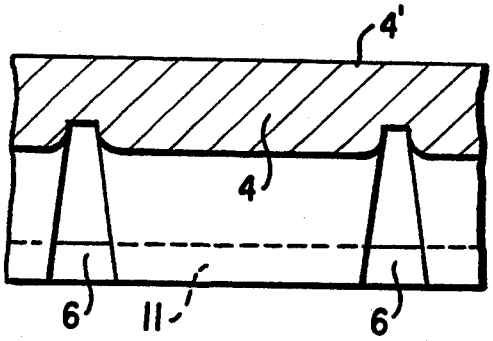
FIG. 8
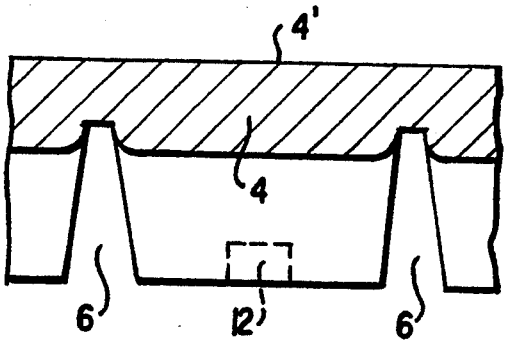
FIG. 9
FIG. 10
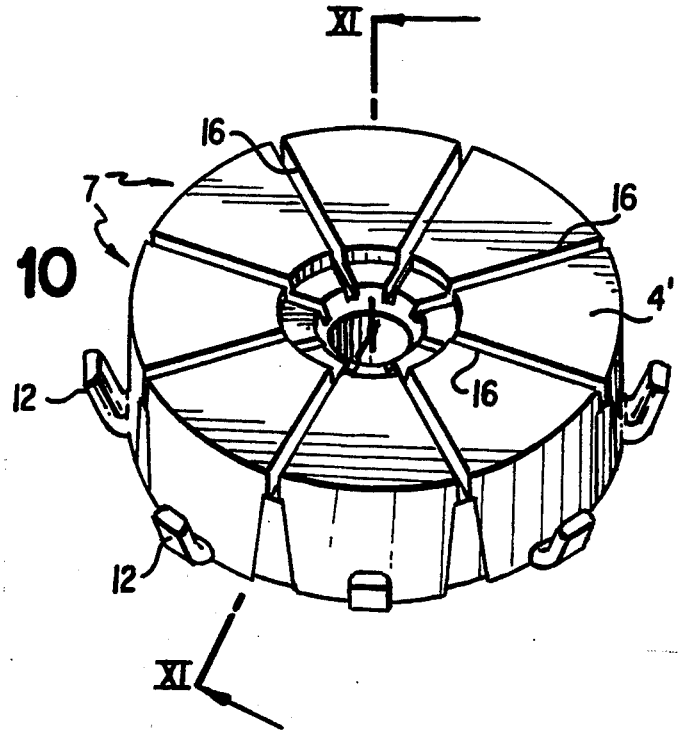
FIG. 11
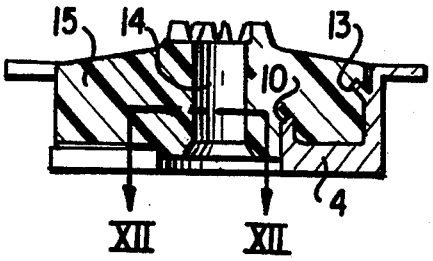
FIG. 12
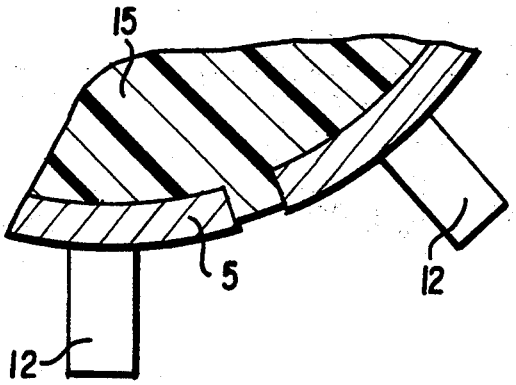

METHOD FOR PRODUCING A MOLDED PLASTIC FLAT ROTARY SWITCH

BACKGROUND OF THE INVENTION

The invention relates to a method for producing a flat rotary switch or commutator of molded plastic and copper and a flat switch made therefrom.

One known method of this type disclosed in U.S. Pat. No. 3,812,576 requires a relatively great number of individual work steps, which in turn, requires transfer between several machines. Such a method can lead to impairment of the secure joining between the segments and the molded plastic.

A primary object of the present invention is to provide a method of the aforementioned type but which allows for cost-effective manufacture of the switch without impairment of the quality of the switch. Other objects and advantages will become apparent from the description which follows.

SUMMARY OF THE INVENTION

The separation of the segments in the area of the cylindrical wall of the unfinished piece during shaping of the annular flange considerably simplifies the production method, since on the one hand a separate work process for separating the segments in the area of the cylindrical wall is deleted, and on the other hand this separation can be undertaken before the molded plastic compound is shaped into the unfinished piece. Separation of the segments in the area of the cylindrical wall can thus be worked out to not have a negative effect on the secure anchoring of the segments in the plastic material.

The unfinished piece is preferably manufactured by extrusion process, since during this type of mechanical shaping the flat part can be provided with radial splines on the inside, which are aligned with the grooves and are then continued into these grooves. These radial splines, along which the separation cuts are guided for division of the flat part into segments, have the effect of reducing the required depth of these separation cuts, which not only reduces the outlay for the separation but also contributes considerably to not compromising the secure anchoring of the segments in the plastic material.

The modification occurring during the extrusion process furthermore facilitates the simultaneous formation of a rim of inside anchoring elements without additional outlay. Therefore it is advantageous that the inside anchoring elements be separated from one another by the splines running up to the rim of the central bore.

The grooves and preferably also the splines are then advantageously configured with a wedge-like shape widening out toward the outside edge of the cylindrical wall. On the one hand such a shape is favorable from the point of view of technical shaping controls. On the other hand with grooves of such a shape it is not difficult to pack said grooves during subsequent introduction of the plastic material.

In one preferred embodiment a disk is used as starting material. This disk can be stamped out of a piece of sheet metal or a strip. Less material is then wasted if the disk is formed of a cut from rod stock.

It is also advantageous that the inside anchoring elements be bent radially outward to increase their effectiveness. This bending process can occur in a work step together with the separation of outside anchoring elements from the inside of the cylindrical wall.

BRIEF DESCRIPTION OF THE DRAWINGS

The present invention will be described in greater detail hereinafter relative to one exemplary embodiment shown in the drawings, wherein:

FIG. 8 is an incomplete and enlarged representation of the section through the flat part with the plan view on the inside surface of the cylindrical wall following the shaping of the annular flange;

FIG. 9 is a section and a view corresponding to that of FIG. 8 following the stamping of the connecting elements;

FIG. 10 is a perspective representation of a view of the exemplary embodiment in finished state;

FIG. 11 is a section along line XI—XI of FIG. 10 of the exemplary embodiment before the bending of the connecting elements; and FIG. 12 is an incomplete representation of a section along line XII—XII of FIG. 11.

DETAILED DESCRIPTION OF THE PREFERRED EMBODIMENTS

Figure 1:
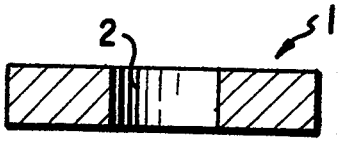
FIG. 1 is a transverse section of a disk.
Figure 2:
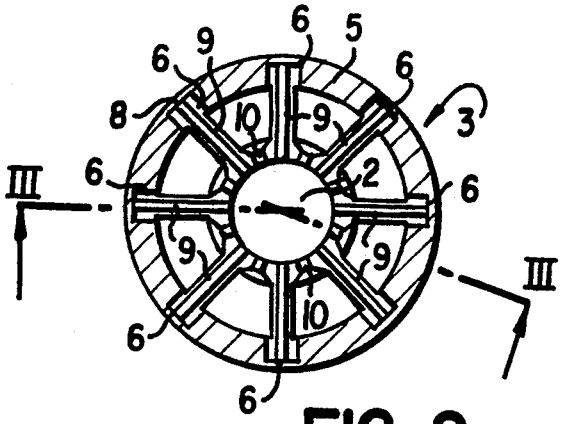
FIG. 2 is a transverse section of the formed article produced from the disk.
Figure 3:
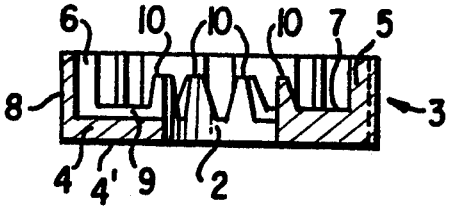
FIG. 3 is a section along line III—III of FIG. 2.
Figure 4:
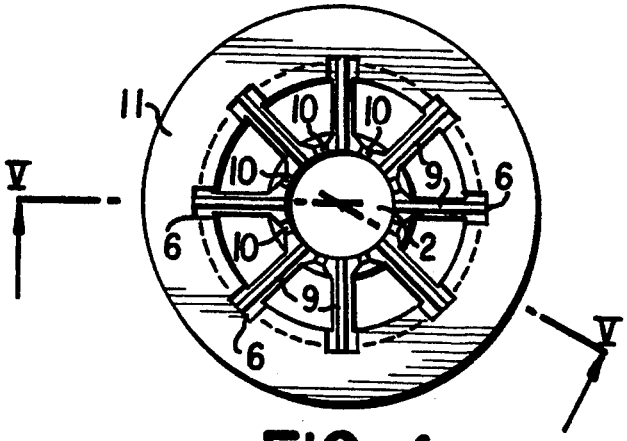
FIG. 4 is a plan view of the reverse side of the unfinished piece following the shaping of the annular flange.
Figure 5:
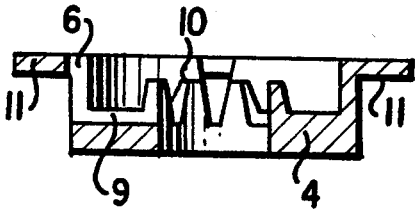
FIG. 5 is a section along line V—V of FIG. 4.
Figure 6:
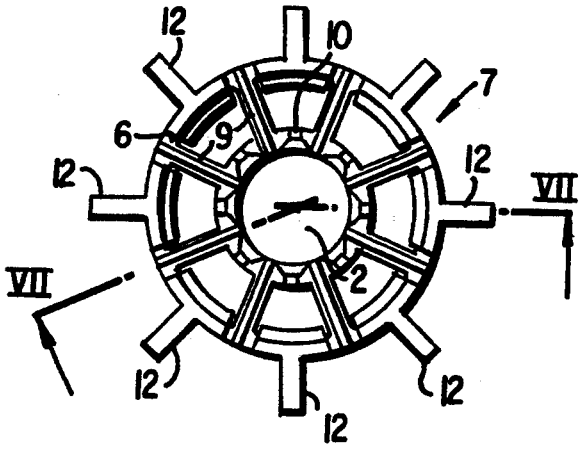
FIG. 6 is a plan view of the reverse side of the unfinished piece following the stamping of the connecting elements and the shaping of the anchoring elements.
Figure 7:
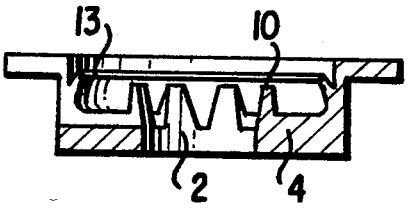
FIG. 7 is a section along line VII—VII of FIG. 6.

Referring now to the drawings wherein like numerals indicate like elements throughout the several views. For the production of the exemplary embodiment shown in the drawing of a molded plastic flat rotary switch, an annular disk is cut out of a piece of rod stock of copper. If the rod stock is a thick-walled pipe, then the cut piece forms a disk 1, as shown in FIG. 1. On the other hand if the cut is cut out from solid material, then subsequently a central hole 2 must be stamped out for formation of disk 1. In an exemplary embodiment, disk 1 has an outside diameter of somewhat more than 20 mm and a thickness of 4 mm. Then, the cup-shaped unfinished piece 3 shown in FIGS. 2 and 3 is molded by means of an extrusion process, which forms a circular flat part 4 and a tubular casing 5 attached thereto.

With the modification of disk 1, grooves 6 are formed on the inside of casing 5 in this casing running in axial direction and open toward the center, and the number of grooves corresponds to the number of segments 7 of the rotary switch. Grooves 6 are uniformly distributed around the periphery of casing 5.

As shown especially in FIGS. 8 and 9, the width of the grooves decreases uniformly from the open front surface of casing 5 out toward flat part 4. The angle formed by the groove sides is approximately 15 degrees in the exemplary embodiment. Following their formation, grooves 6 are each closed radially on the outside by extra material parts 8 (FIG. 2). With the modification of disk 1, flat part 4 is also provided on its inside with radial splines 9, each of which is aligned one on each groove 6 and, as shown especially in FIG. 3, the splines are subsequently continued into the grooves. The width of splines 9 corresponds to the width of grooves 6 at their flat-part ends. Since segments 7 are separated from one another by separating cuts running along splines 9, the cut depth required is considerably reduced by splines 9, reduced in the exemplary embodiment to less than 2 mm. Since splines 9 extend to the edge of central hole 2, a collar edging central hole 2, shaped by splines 9 during the inside modification on the flat part, is subdivided into a number of identically configured anchoring elements 10 corresponding to the number of segments 7.

At the free end of casing 5 of unfinished piece 3 a radial outwardly projecting annular flange 11 is formed in the next work step. The extra material parts 8 are removed at the same time, whereupon segments 7 are separated from one another in the area of the casing.

Beginning at the outside front surface of flat part 4, a layer of material of which the thickness is identical to the thickness of extra material parts 8 or is only slightly greater is pushed back in axial direction by means of a tool in the form of a cylindrical bushing against the free end of casing 5, where an annular space corresponding to the annular flange to be formed is present in a tool receiving unfinished piece 3, and the displaced material flows into the space. The radial thickness of extra material parts 8 is thus defined so that the volume of the displaced material layer suffices for the formation of annular flange 11.

Then annular flange 11, if required, can be defined by means of the same forming press with which the extrusion process of disk 1 and the formation of annular flange 11 as well as the segmenting of casing 5 has been carried out.

In another work step, which can be carried out by means of a press of which the pressure force is considerably smaller than that which is used for the extrusion process, the connection elements are now formed from annular flange 11, and arranged in the middle of segments 7. With this stamping step, anchoring elements 13 are also separated off on the inside of casing 5 out from the flange side. Furthermore the inside anchoring elements 10 are bent radially outward to improve their anchoring effect. In the next step of the process the unfinished piece is filled with plastic material 15 when a central hub bore 14 is left open.

The form which thus receives unfinished piece 3 is provided with ribs which penetrate slightly from the outside into the grooves 6 and pack these grooves tightly. The bearing pressure of the sides of the ribs on the sides of grooves 6, required for this purpose and obtained by virtue of the wedge-shaped grooves 6 tapering to the flat part 4 can be reached without any problem. The penetration depth of the ribs is shown in FIG. 12. Following the hardening of plastic material 15, flat part 4 is segmented by cuts running along ribs 9, penetrating therein from brush contact surface 4'. The slots formed by these cuts, which, as shown in FIG. 10, penetrate also for some distance into plastic material 15, are indicated as 16. Connecting elements 12 are also bent down toward brush contact surface 4'. Insofar as it is required, hub bore 14 is further hollowed out and the poured-on head of the hub body formed by plastic material 15 is removed.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. Method for producing a molded plastic and copper flat rotary switch or commutator having a plurality of segments and a plurality of connecting elements at the free end of those parts of the segments lying in a cylindrical surface of said commutator, comprising the steps of:

a) providing a cup-shaped unfinished piece having a flat part and a plurality of axial grooves in its cylindrical part open on the inside and uniformly distributed around the periphery of the cylindrical part;

b) forming an annular flange and opening the grooves on the outside of the cylindrical part of the unfinished piece by pushing toward the free end of the cylindrical part an outer layer of the cylindrical part having a thickness according to the thickness of one of a plurality of material parts occluding said grooves wherein said flange is formed of the material displaced from said grooves;

c) filling the inside chamber of the unfinished piece with a plastic material;

d) removing portions of the annular flange, as required, to form the connecting elements; and e) subdividing the unfinished piece by forming radial slots into the flat part.

2. Method as in claim 1, wherein the unfinished piece is produced by extrusion and that along with this transformation, a plurality of radial splines are formed on the inside of said flat part, said splines being aligned and engaged with said grooves.

3. Method as in claim 2, wherein with the transformation caused by the extrusion process a ring of inside anchoring elements is formed in an annular zone bordering the central hole, the anchoring elements projecting axially from the inside of said flat part and being separated from one another by said splines formed in the flat part.

4. Method as in claim 3, wherein said grooves and preferably also said splines are formed in a wedge-shaped taper increasing in width from said flat part toward a free edge of the casing.

5. Method as in claim 4, wherein a disk is used as starting method.

6. Method as in claim 5, wherein the disk is separated from a rod or a hollow rod.

7. Method as in claim 6, wherein the inside anchoring elements are bent radially outward and during this step the outside anchoring elements are separated from the inside of the casing.

8. Method as in claim 7, wherein in a casting mold in which the unfinished piece is brought for filling with a plastic material, a discharge of plastic material from said grooves is prevented by fitting packing ribs into said grooves in sealing engagement therewith.

* * * * *